United States Patent [19]

Swanson

[11] 3,937,140

[45] Feb. 10, 1976

[54] BALER WITH EXTERIOR PLATEN GUIDE

[75] Inventor: Dennis E. Swanson, St. Cloud, Minn.

[73] Assignee: Muncher Corporation, St. Cloud, Minn.

[22] Filed: Oct. 3, 1974

[21] Appl. No.: 511,751

[52] U.S. Cl. ..... 100/245; 100/215; 100/258 R; 100/272; 100/286

[51] Int. Cl.[2] ..... B30B 1/16

[58] Field of Search ..... 100/245, 240, 67, 258 R, 100/258 A, 270, 272, 286, 215

[56] References Cited

UNITED STATES PATENTS 3,728,959 4/1973 Fredrickson ..... 100/272 X

FOREIGN PATENTS OR APPLICATIONS 773,068 4/1957 United Kingdom ..... 100/245

*Primary Examiner*—Billy J. Wilhite

*Attorney, Agent, or Firm*—James R. Haller; H. Dale Palmatier

[57] ABSTRACT

A baler for baling refuse and having a pressing platen and a platen guide. The platen guide includes spaced sets of rollers bearing inwardly against opposed sides of the baler, and brackets rigidly attached to the platen and extending externally of the baler for mounting the rollers in engagement with the pressing box sides.

9 Claims, 7 Drawing Figures

BALER WITH EXTERIOR PLATEN GUIDE

BACKGROUND OF THE INVENTION

The compaction of refuse such as cardboard boxes, paper, cans, and the like into compact bales for disposal has met with increasing acceptance by many businesses as an alternative to burning or collecting refuse in loose, messy piles for later disposal. Baling compacts refuse into easily manageable, dense bales for appropriate disposal by recycling or the like.

Commonly owned U.S. Pat. No. 3,728,959 describes a baler which may conveniently be used in small businesses such as supermarkets to dispose of cardboard boxes and like refuse. The baler of this patent includes a pressing box and platen, and a hydraulically actuated toggle mechanism to move the platen axially within the box to compress refuse into a bale. The walls of the pressing box necessarily are exceedingly stiff and strong to resist bowing out under the pressures generated within the box during a baling operation.

When refuse is charged to the pressing box of a baler such as that described in the above-identified U.S. patent, the refuse is seldom distributed evenly within the pressing box. Rather, refuse will build up at one or more walls of the pressing box, generally the rear wall, opposite the refuse charging door of the baler. The resulting uneven load against which the platen moves may in some cases tend to cock the platen with respect to the axis of the baler, the platen in some instances coming into contact with and scoring or gouging the side walls of the pressing box. For convenience in removing a bale, the side walls of the pressing box may diverge outwardly slightly toward the bale removal door, and this feature, coupled with the accumulation of refuse preferentially along the wall near the rear of the pressing box, appears to shift the bale refuse forwardly in the pressing box during a pressing cycle, this movement tending to displace the platen toward the front of the baler.

For practical purposes, a baler should be rugged and capable of developing high baling pressures to yield a bale of high density and low bulk. The platen should move freely within the pressing box and should be restrained from cocking or contacting the walls of the box. On the other hand, a baler should not be of such extraordinary weight or bulk as to render it non-portable from a practical standpoint or to render it so expensive as to preclude its practical use in small businesses.

SUMMARY OF THE INVENTION

The present invention relates to a baler for bailing refuse and the like. The baler includes a platen guide which not only restrains non-axial movement of the platen with respect to the baler but also rigidifies and strengthens opposed pressing box walls. The baler of the invention includes a pressing box and a platen movable axially in the pressing box to compress refuse into a bale. Hydraulic means are provided to move the platen between a withdrawn position which permits refuse to be charged to the pressing box, as through a separate charging door in the front wall of the box, and a refuse compressing position in which the platen moves to compress charged refuse into a bale. The platen guide comprises sets of rollers bearing inwardly against opposed sides of the baler. Brackets are rigidly attached to the platen and extend externally of the pressing box for mounting the rollers in engagement with the opposed pressing box sides. Each roller set includes at least two, and desirably more, rollers, with at least one roller of each set spaced axially of the pressing box from another roller of that set. The sets of rollers thus continuously maintain the orientation of the platen with respect to the side walls, and hence the axis, of the pressing box, and the inward pressure of the rollers against the sides of the box reinforce the latter against compression forces within the box tending to bow the box sides outwardly.

BRIEF DESCRIPTION OF THE DRAWING

FIG. 1 is a perspective view of a baler of the invention;

DETAILED DESCRIPTION OF THE PREFERRED EMBODIMENT

Figure 2:
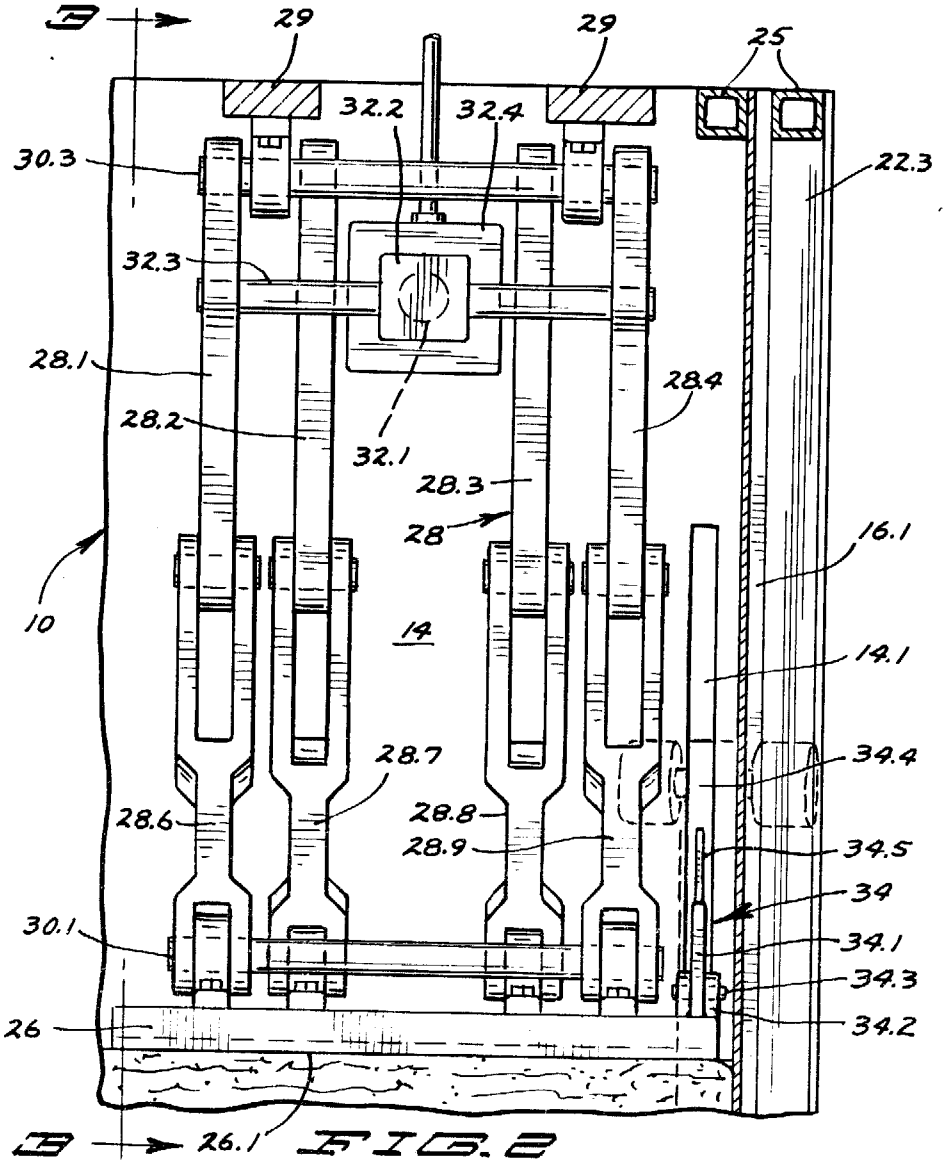
FIG. 2 is a broken away, cross-sectional side view of the baler of FIG. 1.
Figure 3:
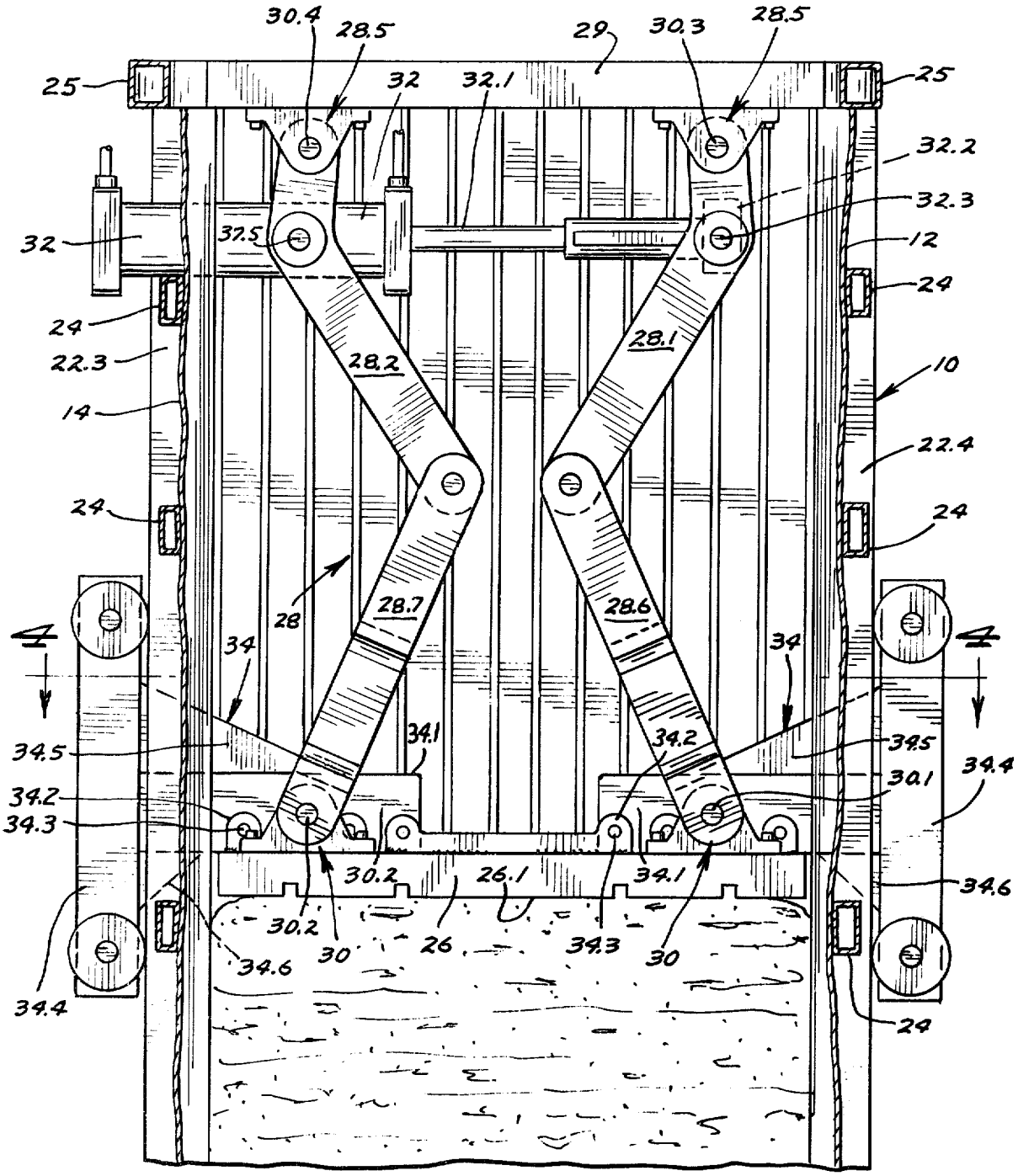
FIG. 3 is a broken away view, in partial cross section, taken along line 3—3 of FIG. 2.
Figure 4:
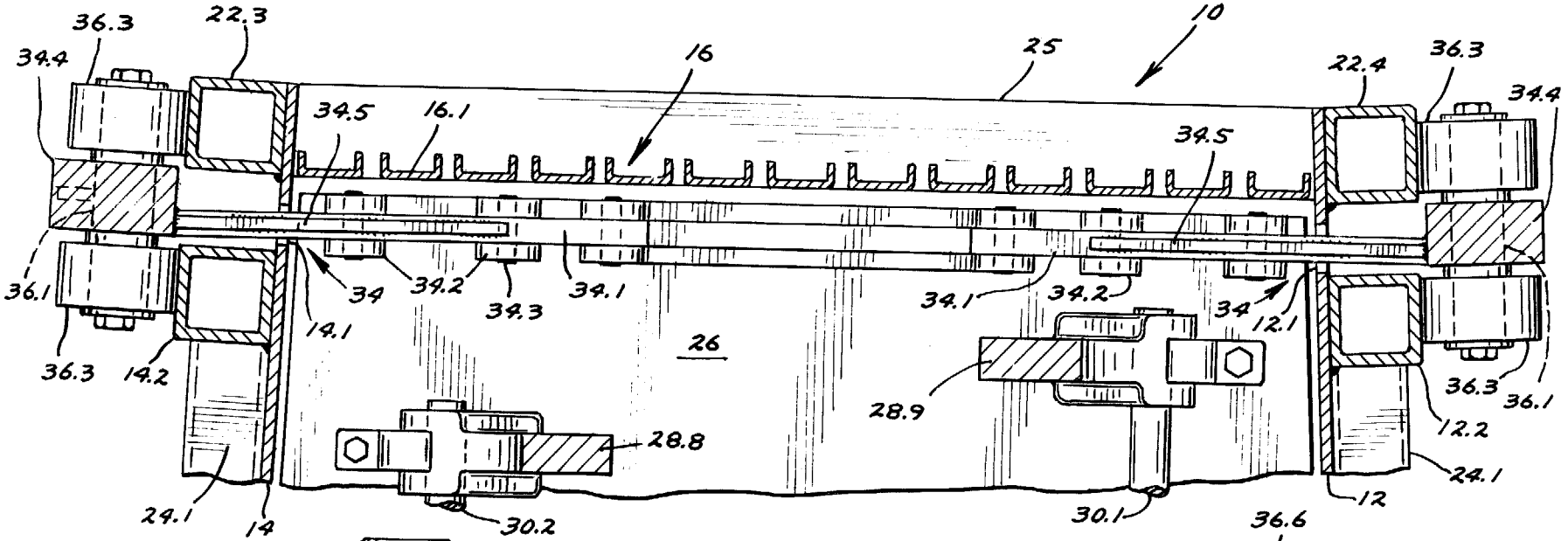
FIG. 4 is a cross sectional view, partially broken away, taken along line 4—4 of FIG. 3.
Figure 7:
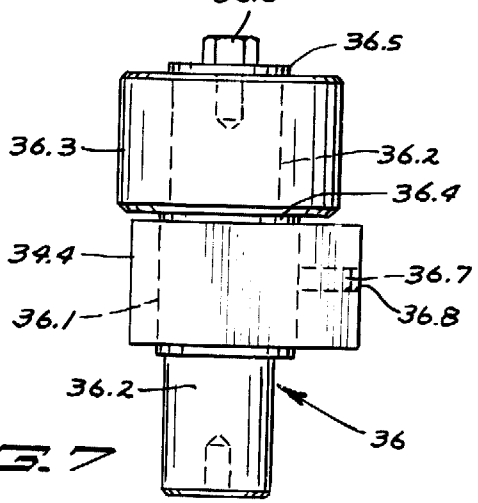

Referring first to FIGS. 1–3, the baler of the present invention is shown in its upright position and is designated generally as 10. The baler includes upright side walls 12, 14, a rear wall 16, and a front wall comprising a lower, bale-removal door 18 which may occupy the lower half of the heighth of the baler, and an upper, refuse-charging door 20. At its four corners, the pressing box is supported by upright beams which may be of tubular steel having a rectangular cross section, as shown in FIG. 4, the front beams being designated 22.1, 22.2 and the rear beams being designated 22.3, 22.4. The side walls 12, 14 of the pressing box may in addition include transverse beam supports shown generally in the drawing as 24. The side walls 12 may be of sheet steel, welded or otherwise attached to the upright corner beams and the transverse beam supports.

The bale-removal door 18 is hinged at one side to the upright beam 22.2 as shown in FIG. 1, and includes a heavy duty latch (not shown) at its other side. The refuse charging door 20 is movable vertically, sliding on vertical tracks 20.1, 20.2 carried by the corner beams 22.1, 22.2. A hydraulic cylinder 20.3 is provided to move the door between an upper position in which the lower interior of the pressing box is exposed for charging refuse and a lower, closed position, the latter being shown in FIG. 1. An upright safety housing 20.4 is mounted at the front of the refuse charging door 20 to receive the body of the hydraulic cylinder 20.3 as the door is raised to its refuse charging position.

In addition to the corner beams 22.1–22.4 and the transverse beams 24, the pressing box is provided with further transverse supporting beams 25 at its upper and lower edges. The rear wall 16 of the pressing box may comprise a series of upright, spaced, U-shaped parallel spines 16.1 as shown best in FIG. 4, the slots between adjacent spines permitting lengths of baling wire or twine to be passed around, and secured about formed bales.

A pressing platen 26 is carried within the pressing box and is moved upwardly and downwardly along the upright axis of the pressing box by means of a hydraulically actuated toggle mechanism designated generally as 28 in the drawing. The bottom surface 26.1 of the platen is slotted from front to rear, as shown in FIG. 3, the slots in the platen matching slots between the spines 16.1 of the rear wall 16 for passing baling wire about a formed bale. The toggle mechanism 28 comprises four pairs of articulated arms positioned generally adjacent the four upright edges of the pressing box. Each set of arms includes an upper arm 28.1, 28.2, 28.3, 28.4 which is swingably mounted by means of brackets and pins shown generally as 28.5 to upper support bars 29, the latter extending between the transverse support beams 25 at the upper edges of the side wall of the box. The upper arms 28.1, 28.2 are positioned near the front of the pressing box, and the arms 28.3, 28.4 are nearer the rear of the box, as shown best in FIG. 2. The lower arms 28.6, 28.7, 28.8, 28.9 of each set are hinged at their upper ends to the lower ends of the arms 28.1–28.4 respectively, and are hinged at their lower ends to the upper surface of the platen by brackets and pins designated generally as 30 in FIG. 3.

As shown best in FIG. 2, the ends of the lower arms 28.6–28.9 are bifurcated, and the lower ends of these arms are attached to brackets arising from the platen by means of pins, a common pin 30.1 extending through the lower ends of the arms 28.6 and 28.9 and another pin 30.2 extending through the lower ends of the arms 28.7 and 28.8. The upper bifurcated ends of the lower arms 28.6–28.9 enclose and are hinged to the lower ends of the upper arms 28.1–28.4, respectively, as shown best in FIG. 2. The upper arms 28.1–28.4 are mounted to brackets depending from the transverse bars 29 by means of pins 30.3, 30.4, the former pin extending through the upper ends of the arms 28.1 and 28.4 and the later pin extending through the upper ends of arms 28.2 and 28.3. The pins 30.1–30.4, which define the axes of rotation of the arms, are parallel to one another and are normal to the rear wall 16. All of the upper arms are of the same length and all of the lower arms are of the same length, and desirably the upper and lower arms are of equal length. The sets of arms adjacent one side of the pressing box (28.2, 28.7 and 28.3, 28.8) are spaced apart a lesser distance than are the arms arising from the other side of the pressing box such that when the platen is raised to its withdrawn position, the sets of arms adjacent the one side of the box cross and are received between the arms adjacent the other side of the box. The thus-described interfolding relationship of the arm sets provides the baler with a longer pressing stroke. When the platen is in its withdrawn position adjacent the top of the baler, the collapsed, interfolded arms take up little space, thereby affording a large charging volume for the baler.

The upper arms 28.1–28.4 have an inward bend adjacent their upper ends, as shown in FIG. 3 the bend in each arm defining an upper and lower arm length which meet at the bend at an obtuse angle. A hydraulic cylinder and piston 32, 32.1 are oriented transversely of the pressing box with the outwardly extending end of the piston mounted to a mounting plate 32.2 carrying a support rod 32.2 which is pivotally mounted to the upper arms 28.1, 28.4 at the bends in these arms, the rod 32.3 being parallel to the pins 30.1–30.4. The cylinder carries a mounting bracket 32.4 (FIG. 2) along its length, the latter having transversely extending support rods 32.5 (FIG. 3) which are pivotally connected to the bends in the upper arms 28.2, 28.3. The cylinder may extend outwardly of the pressing box through an opening in the side wall, as shown in FIG. 3. It will be understood that as the piston is caused to extend from the cylinder, the upper arms are forced to pivot outwardly about the pins 30.3, 30.4, causing the arm sets to unfold and straighten and force the platen 26 in a downward direction to compress refuse within the lower portion of the pressing box. As the arms approach a completely unfolded position; that is, as the arms approach position parallel to the axis of the pressing box, the ratio of the rate of extension of the piston to the rate of descent of the platen increases greatly, resulting in the exertion by the platen of great force against refuse in the pressing box. As the piston 32.1 is retracted within the cylinder, the upper arms are pivoted inwardly of the pressing box, resulting in interfolding of the arms as described above and the platen is thus returned to its withdrawn position.

From the above description, it will be understood that the piston and cylinder are carried by, and move with, the upper arms. In some instances it has been found that the arms set near one side of the box unfold at a slightly slower rate than do the arms at the other side of the box during a pressing cycle, this problem usually resulting from an uneven distribution of refuse in the box such that the platen contacts refuse nearer the one side of the box earlier in its downward stroke. As a result, the platen may be tilted or cocked within the pressing box with the result that the pressing box sides may become scored and gouged. To elliminate this problem, I provide exterior guide rolls which are rigidly mounted to the platen and which maintain the platen in its desired orientation with respect to the axis of the pressing box.

To the upper surface of the platen, desirably near its rear edge, are attached a pair of brackets designated generally as 34. Each bracket includes a transverse, upright plate 34.1 which passes between mounting lugs 34.2 arising from the upper surface of the platen and which is rigidly connected to the mounting lugs by means of pins 34.3. Each plate passes outwardly of the pressing box through upright slots 12.1, 14.1 formed in the side walls 12, 14 of the pressing box, respectively. As shown best in FIG. 4, I desire that the upright slots 12.1, 14.1 be formed slightly forwardly of the rear corner beams 22.4, 22.3, respectively. Another pair of upright support beams 12.2, 14.2 (FIGS. 1 and 4) are provided just forward of the slots, and are welded to the side walls 12, 14, to the transverse support beams 25 at the upper edges of the box sides, and to transverse beam members 24.1 which extend between the corner beams 22.2, 22.4 and 22.1, 22.3, adjacent the bottom of the baler. The upright support beams 12.1, 14.2 thus form part of the rigid exterior framework of the baler, and may be of tubular steel of generally rectangular cross section, as depicted in FIG. 4. The closely adjacent, upright beam pairs 14.2, 22.3 and 12.2, 22.4 stiffen the edges of the slots 12.1, 14.1 in the side walls. If desired, the slots may extend to the confronting edges of the beam pairs.

Each of the roller brackets 34 include an elongated, upright roller arm 34.4 rigidly mounted by welding or the like to the outwardly extending end of the mounting plate 34.1, with each roller arm desirably extending both above and below the platen as shown best in FIG. 3 such that at least one roller precedes or leads the platen as the latter moves in a pressing stroke. Upper and lower gussets 34.5, 34.6 are provided between the upright mounting plates 34.1 and their respective roller arms 34.4, as shown best in FIGS. 3 and 4, to further rigidify the bracket 34.

As shown best in FIG. 4, the side walls 12, 14 of the pressing box diverge frontwardly to enable a bale to be easily removed from the box. Each side wall diverges from normalcy to the rear wall 16 of the box by an angle of about 3 degrees. The side edges of the platen 26 are similarly divergent frontwardly so as to maintain constant spacing between the platen side edges and the side walls 12, 14 of the pressing box. The upright, supporting beams on either side of the side wall slots also deviate from normalcy to the rear wall 16 of the pressing box by an angle of about 3 degrees, and the roller arms 34.4 are welded or otherwise attached to the upright mounting plates 34.1 and to the gussets 34.5, 34.6, also at a slight angle of about 3 degrees.

Figure 7:
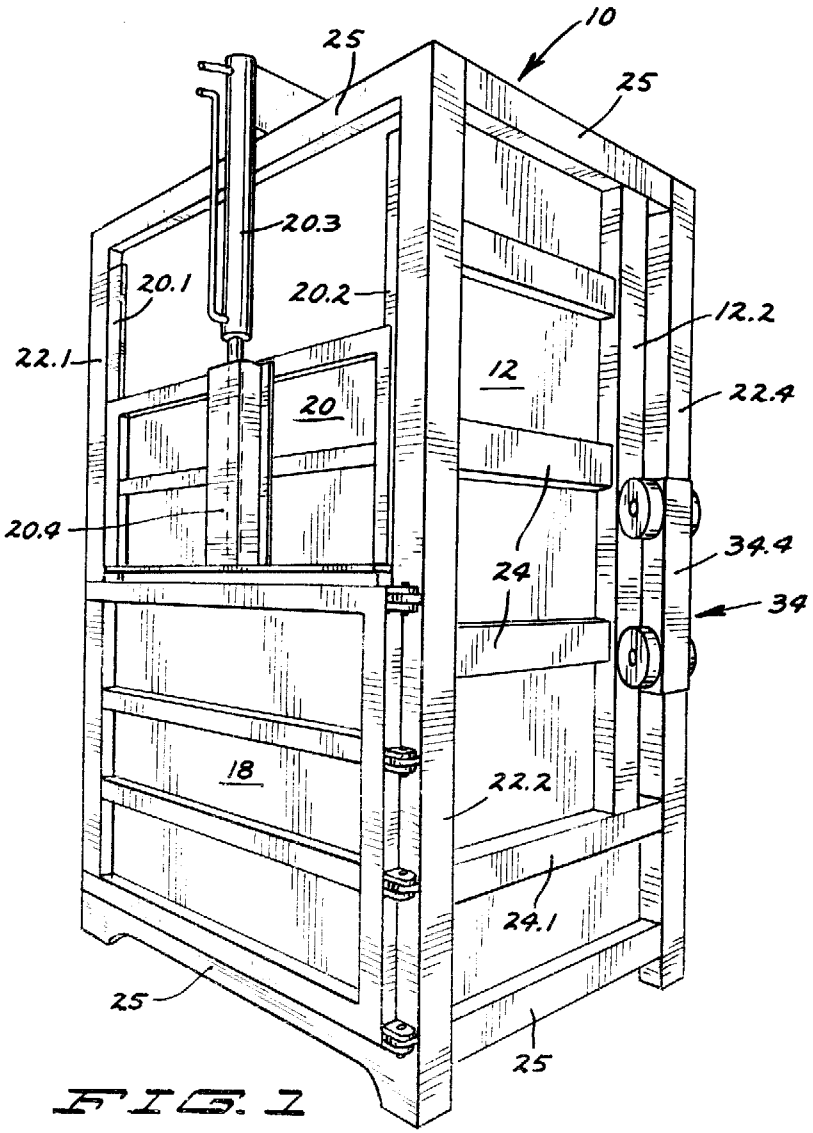
FIG. 7 is a plan view of the roller mounting pin of FIGS. 5 and 6 shown partially assembled with a roller and supporting structure.
Figure 6:
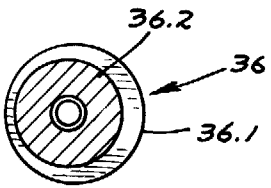
FIG. 6 is a cross sectional view taken along line 6—6 of FIG. 5.
Figure 5:
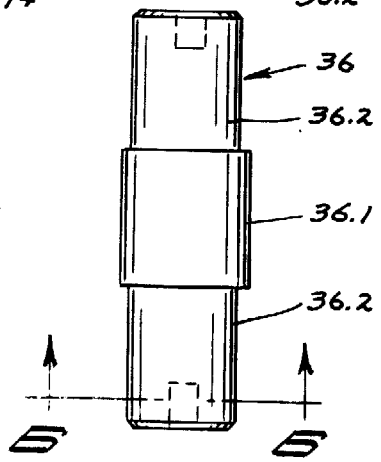
FIG. 5 is a plan view of a roller mounting pin shown also in FIG. 4.

The upper and lower ends of each roller arm 34.4 is provided with a bore to receive the central portion 36.1 of a roller axle 36, the latter being depicted in FIGS. 5–7 and having axes generally parallel to the side. Each axle 36 has end sections 36.2 upon which steel rollers 36.3 are rotatably mounted. A low friction bearing material may be employed, if desired, to increase the ease with which the rollers 36.3 turn on the axle, and a washer 36.4 may be inserted between the roller and the adjacent surface of the roller arm. The ends of the axle are bored and threaded to a given distance, as shown in FIG. 7, and a hold-down disk 36.5 is placed at the end of each axle with its outer periphery overlying the sides of the roller. A machine screw 36.6 is turned tightly into the threaded bore at the end of the axle, clamping the disk 36.5 to the end of the axle and permitting the roller 36.3 a very slight amount of freedom axially of the axle so as to freely turn on the axle. The central portion 36.1 of the axle which is received within the bore in each end of the roller arm is eccentric with respect to the axle end portions 36.2. Thus, by rotating the center portion of the axle within the roller arm bore, the rollers 36.3 may be moved toward or away from the sides of the pressing box. An externally accessible set screw 36.7, threaded into a threaded through-hole 36.8 in the end of the roller arm, locks the eccentric in place.

The rollers 36.3 at each end of a roller arm are spaced transversely apart by the roller arm and washers 36.4 so as to come into face-to-face contact with the external surfaces of the upright support beam on either side of the slots in the side wall. If desired, the beam surfaces which are contacted by the rollers may be appropriately tracked or grooved so as to restrain the rollers from any movement forwardly or rearwardly of the pressing box. Because of the slight divergence of the accompanying slight angle formed between the outer surfaces of the upright beams along which roll the rollers 36.3, the rollers are prevented from moving in a frontward direction with respect to the pressing box. Since, as noted above, the debris which is charged to the pressing box often accumulates preferentially nearer the rear wall 16 thereof, the platen 26 tends to be urged forwardly slightly as it moves downwardly to compress the refuse into a bale. It will be understood that this forward urging of the platen is substantially completely counteracted by the slight angle between the outer surfaces of the upright beams upon which ride the rollers 36.3.

The rollers carried by the upper ends of the roller arms are spaced a substantial distance above the rollers carried by the lower ends of the roller arms. As the rollers are in continuous contact with the upright beams adjacent the slots in the side walls of the pressing box, the rollers, the brackets which connect the rollers, to the platen, and the platen itself are all maintained in precise and continuous orientation with respect to the axis of the pressing box as the platen moves downwardly and upwardly within the box.

Speaking broadly, it will be understood that to precisely and continuously maintain the orientation of the platen with respect to the axis of the box, each of the brackets 34 must carry at least two rollers spaced axially from one another a substantial distance. Moreover, it is desired that the rollers carried by the lower ends of the roller arms 34.4 be oriented below the bottom surface 26.1 of the platen so that as the platen descends in a pressing stroke, the pressure which is generated in the pressing box and which acts outwardly against the side walls of the box is at least partially countered by the inward pressure exerted by the rollers at the bottom of the roller arm against the beams on either side of the side wall slots.

In use, the platen is initially in its upper, withdrawn position with the toggle arms compactly interfolded near the top of the pressing box. The refuse charging door 20 is opened by actuation of the hydraulic cylinder 20.3, and refuse such as cardboard boxes, tin cans, and the like are charged into the pressing box below the platen. The charging door 20 is then closed, again by actuation of the of the hydraulic cylinder 20.3, and the hydraulic cylinder 32 is then actuated to cause the piston to extend therefrom and thus move the platen in a downward direction. The aligned, front and rear toggle arms on each side of the pressing box are required to move in unison because of their common attachment to the support bars, platen, and hydraulic cylinder and piston. As a result, the front-to-rear orientation of the platen with respect to the axis of the pressing box is maintained closely. Moveover, because of the rollers which roll along the outer edges of the upright support beams on either side of the wall slots, the platen is maintained in very close and continuous orientation with respect to the box axis.

All of the rollers are maintained in pressing, rolling engagement with the upright beams by occasional adjustment of the angular orientation of the axle eccentric cam 36.1 within the bore in the upper and lower ends of the roller arms 34.4, as described above. The eccentric center 66.1 of each axle may be easily turned within the bore by first loosening the set screw 36.7 and then turning, with a wrench, the screw 36.6 (which is very tightly threaded into its threaded bore in the end of the axle) until the rollers carried by the axle are in snug engagement with the outer surfaces of the upright beams.

Because of the inward pressure which is exerted on the side walls of the pressing box by the rollers, as described above, it is possible to reduce the heaviness of the side wall structure to reduce both the weight and expense of the baler. The rollers at the lower ends of the roller arms, which desirably extend below the lower surface 26.1 of the platen, continuously maintain inward pressure on the side walls of the baler at the points at which reinforcement, if any, is needed; that is, these rollers provide inward pressure on the side walls at points generally spaced above the transverse side vall supports 24.1 and 25 (FIG. 1) but at points spaced below the platen itself. Moreover, the inward pressure developed by the rolls at the lower ends of the roller arms is not directed at a set point along the height of the side walls, but rather is dependent upon the position of the platen, the platen in effect carrying with it its own means for stabilizing the side walls against pressure developed by it in a downward, pressing stroke.

In a baler of the invention having a size approximately the same as that described in commonly owned U.S. Pat. No. 3,728,959, the upright beams on either side of the slots of the side walls may be of four inch square tubular steel and have walls 3/16ths of an inch thick. The slot itself may be two inches wide, and it has been found that little if any refuse tends to enter the slots during a pressing cycle. Although the platen guide of the invention desirably is used in connection with the toggle arm mechanism described above, it may also be employed with substantially any mechanism for raising and lowering the platen. Further, although the platen roller guides have been described above and depicted in the drawing as being oriented near the rear of the side walls, it will be understood that such rollers may be located at substantially any point across the width of the side walls, and are desirably, but not necessarily, maintained in opposed relationship to each other on opposed side walls of the pressing box. Moreover, if desired, several brackets and several roller guides may be employed across the width of the side walls of the pressing box. The rollers themselves may, of course, be of different sizes on the same axle providing that the upright beams engaged by the rollers are appropriately dimensioned. Also, the rollers at upper ends of the roller arms may be of different sizes than the rollers at the lower ends of such arms.

While I have described a preferred embodiment of the present invention, it should be understood that various changes, adaptations, and modifications may be made therein without departing from the spirit of the invention and the scope of the appended claims.

What is claimed is:

1. In a baler for baling refuse and the like and including a pressing box, a platen movable axially in the pressing box to compress refuse into a bale, and hydraulic means to move the platen between a withdrawn position and a refuse compressing position, the improvement comprising platen guide means including sets of rollers bearing inwardly against respective opposed sides of the baler with the roller axes substantially parallel to the respective side walls, and brackets attached to the platen and extending externally of the pressing box for mounting the rollers in rolling engagement inwardly against opposed sides of the pressing box to roll in a direction parallel to the axis of the box, each roller set including at least two rollers spaced axially of the box a significant distance to continuously maintain the orientation of the platen with respect to the axis of the pressing box.

2. In a baler for baling refuse and the like and including a pressing box, a platen movable axially in the pressing box to compress refuse into a bale, and hydraulic means to move the platen between a withdrawn position and a refuse compressing position, the improvement comprising platen guide means including sets of rollers bearing inwardly against respective opposed sides of the baler and bracket attached to the platen and extending externally of the pressing box for mounting the rollers in rolling engagement inwardly against opposed, respective sides of the pressing box to roll in a direction parallel to the axis of the box, each roller set including at least two rollers spaced axially of the box a significant distance to continuously maintain the orientation of the platen with respect to the axis of the pressing box, at least one roller of each roller set being oriented to lead the pressing platen as the latter moves in a refuse compressing stroke, the at least one roller of each set pressing inwardly against the sides of the baler to reinforce the latter against compression forces within the box.

3. The baler of claim 1 including supporting beams extending along side walls of the baler to stiffen and support the latter, the beams defining tracks engaged continuously by the rollers a the platen moves between its withdrawn and refuse compressing positions.

4. The baler of claim 1 including axles mounting the rollers to the brackets, each axle having an eccentric portion bearing against its bracket and rotatable with respect to the bracket to move the rollers away from or toward the pressing box sides.

5. A baler for baling refuse and the like and comprising a pressing box, a platen movable axially in the pressing box to compress refuse into a bale, and hydraulic means to move the platen between a withdrawn position and a refuse compressing position, each side of the pressing box comprising an inner wall with a longitudinal slot therein parallel to the axis of the pressing box and an exterior longitudinal beam at either side of the longitudinal slot and having a tracked outer surface, the baler including brackets rigidly attached to the platen extending through said slots externally of the pressing box, each bracket including a roller arm carried externally of the pressing box and maintained by the bracket in rigid orientation with respect to the platen, each roller arm having upper and lower ends each bearnig a pair of rollers in inwardly pressing, rolling engagement with the tracked outer surfaces of the supporting beams on either side of the side wall slot.

6. The baler according to claim 5 wherein the longitudinal beams which are contacted by the rollers on either side of the pressing box have frontwardly divergent, roller-contacting surfaces, thereby preventing frontward movement of the rollers with respect to said beams.

7. The baler of claim 5 including roller axles, each having end portions upon which are rotatably received the rollers and each having an eccentric center portion received in a bore formed in the upper and lower ends of the roller arms, angular displacement of the eccentric portion of each axle serving to move the rollers toward or away from the sides of the pressing box.

8. A baler for baling refuse and the like and including a pressing box, a platen movable axially in the pressing box to compress refuse into a bale, a hydraulically actuated toggle mechanism for moving the platen between a withdrawn position permitting refuse to be charged to the pressing box, and a refuse compressing position, the toggle mechanism comprising four sets of toggle arms positioned generally adjacent four corners of the pressing box, respectively, and each set comprising upper and lower arms foldingly connected at their ends and having upper and lower ends connected, respectively, to the pressing box and the platen, the sets of toggle arms being so constructed and arranged as to fold inwardly of the sides of the pressing box as the platen is raised to its withdrawn position, first and second arms of each set adjacent one side wall crossing and interfolding with first and second arms, respectively, of the toggle arm set adjacent the opposite side of the pressing box, the toggle mechanism including a hydraulic cylinder and piston oriented generally transversely of the axis of the pressing box and carried respectively between arms at one side of the pressing box and arms at the other side of the pressing box to unfold the sets of toggle arms as the piston extends from the cylinder, the baler including platen guide means comprising sets of rollers bearing inwardly against respective opposed sides of the baler, and brackets attached to the platen and extending externally on either side of the pressing box for mounting the rollers in inwardly bearing engagement with opposed sides of the box, each roller set including at least two rollers with at least one roller of each set spaced axially a substantial distance from another roller of that set to continuously maintain the orientation of the platen with respect to the axis of the pressing box.

9. In a baler for baling refuse and the like and including a pressing box, a platen movable axially in the pressing box to compress refuse into a bale, and hydraulic means to move the platen between a withdrawn position and a refuse compressing postion, the improvement comprising platen guide means including supporting beams having outwardly tracked surfaces and extending longitudinally of the baler along opposed side walls thereof, the side walls having longitudinal slots adjacent the supporting beams, and sets of rollers bearing inwardly against the respective tracked outer surfaces of the beams with the roller axes substantially parallel to the respective side walls, and brackets attached to the platen and extending externally through said slots for mounting the rollers in rolling engagement inwardly against the beams to roll in a direction parallel to the axis of the box, each roller set including at least two rollers spaced axially of the box a significant distance to continuously maintain orientation of the platen with respect to the axis of the pressing box, and the tracks restraining the rollers from movement forwardly of the pressing box.

* * * * *